United States Patent [19]

Alt

[11] Patent Number: 4,622,522

[45] Date of Patent: Nov. 11, 1986

[54] TRACK CIRCUIT FOR AC ELECTRIFIED RAILWAYS

[75] Inventor: Gilbert Alt, Bois-Colombes, France

[73] Assignee: Compagne de Signaux et d'Entreprises Electriques, Paris, France

[21] Appl. No.: 709,393

[22] Filed: Mar. 7, 1985

[30] Foreign Application Priority Data

Jul. 27, 1984 [FR] France ..... 84 12113

[51] Int. Cl.[4] ..... H03H 7/075; H03H 7/09; B61L 1/18

[52] U.S. Cl. ..... 333/24 R; 246/28 R; 246/28 K; 333/168; 333/175; 333/177

[58] Field of Search ..... 333/167, 168, 175–177, 333/181–185, 24 R, 24 C, 1, 4, 5; 246/34 R, 37, 122 R, 122 A, 124, 246, 249

[56] References Cited

U.S. PATENT DOCUMENTS

| | | | |
|---|---|---|---|
| Re. 14,774 | 12/1919 | Fortescue | 333/175 X |
| 1,286,401 | 12/1918 | Peter | 246/37 |
| 1,770,705 | 7/1930 | Lucas | 246/37 |
| 4,487,385 | 12/1984 | Salmon | 246/34 R |
| 4,509,024 | 4/1985 | Wilson | 246/37 X |

*Primary Examiner*—Marvin L. Nussbaum
*Attorney, Agent, or Firm*—Schiller & Pandiscio

[57] ABSTRACT

The present invention provides a track circuit for AC electrified railways, formed by the two rails ($R_1$,$R_2$) of a railway section and comprising a transmitter (E) connected to one end of the track circuit for generating therein an alternating signal of given frequency and a receiver (R) connected to the other end for controlling the operation of a track relay (RV). A number of capacitive impedances ($Z_1$,$Z_2$, . . . $Z_n$) with parallel inductance and capacitor (each having a middle point (3) connected to the ground) are connected between the rails ($R_1$,$R_2$) while being spaced apart over the whole length of the track circuit with a given pitch (P), depending on the values of the impedances, so that the transmission attenuation of the circuit at the operating frequency is always less than the transmission attenuation of a circuit having the same length formed by a rail with ground return.

6 Claims, 4 Drawing Figures

P/2
P
P
P/2
R1
R2
E
Z1
Z2
Z3
Zn
R
RV
J
J
3

R1
R2
C
L
1
2
3

R1
R2
C
L
4
5
6
7
3

R1
R2
C1
C2
L1
L2
8

TRACK CIRCUIT FOR AC ELECTRIFIED RAILWAYS

The present invention relates to a track circuit for AC electrified railways formed by the two rails of a section of track and comprising a transmitter connected to one end of the track circuit for generating therein an alternating signal of given frequency and a receiver connected to the other end for controlling the operation of a track relay.

Such track circuits are at present widely used for ensuring the safety and regularity of train traffic on the railway tracks. With them, in fact, the presence or absence of a vehicle on a given track section may be checked by means of a shunt axle on the vehicle short circuiting the two rails of the corresponding track circuit.

Generally, these track circuits are satisfactory, in particular because of improvements which have reduced, to a satisfactory extent, the attenuation of the transmission of the signal from one end of the track to the other, whatever the transverse insulation conditions of the track.

However, the more widespread use of AC traction and the use of more and more powerful locomotives have raised a new problem, that of the limitation of the rail-ground voltages, that is to say the lowering of the "ground path impedance" defined by the rail-ground voltage/overhead line current ratio. Furthermore, this ground path impedance must be as low as possible so as to protect the staff against accidental short circuits of the overhead line insulators. These two problems are very critical in the case of a single track or of tracks laid on ground of high resistivity.

It is true that the value of the ground path impedance of the track circuits may at the present time be lowered by using inductive connections with the middle point connected to ground, but very strict safety rules, for such track circuits, lay down a minimum distance between two successive ground connections so that, should there be a break in the rail, the track relay does not remain energized by the circuit formed by this rail and ground. Since this minimum distance is 4 km for low frequency track circuits ($F<100$ Hertz) and 1 km for mid-frequency circuits (1500 Hertz$<F<$3000 Hertz) attempts to lower the ground path impedance are very greatly limited in track circuits, as currently known, so much so that they are not suitable for high power locomotives for which it is desirable to dispose a ground connection at least every 300 m.

The present invention sets out to overcome this inconvenience and, for this, it provides a track circuit of the type specified in the preamble which is characterized in that a number of capacitive impedances, with parallel inductance and capacitor, each having a middle point connected to ground, are connected between the rails while being spaced apart over the whole length of the track circuit with a given spacing, depending on the values of the impedances, so that the transmission attenuation of the circuit at the operating frequency is always less than the transmission attenuation of a circuit of the same length formed by a rail with ground return.

Preferably, the impedances have substantially identical values and are spaced with a constant pitch therebetween, the two end impedances being separated from the transmitter and from the receiver respectively by a distance substantially equal to half of this pitch.

Thus, the invention provides an improved track circuit which, while keeping the properties of traditional track circuits, establishes a ground path impedance appreciably smaller than this latter.

In fact, by a judicious choice of the values of the impedances and the pitch at which they are spaced along the circuit, the transmission attenuation of the track circuit, effected by the capacitors, may be reduced to a value such that the voltage at the terminals of the receiver, under the most unfavorable conditions, is always higher than that received by this receiver should a rail be broken, i.e. when the receiver is supplied by a circuit formed by a single rail and the ground or a single rail and the ground cable. Thus, the track circuit of the invention provides the possibility of detecting broken rails and is free from the above mentioned restrictions. Consequently, the ground inductances may be sufficiently close to each other in the same track circuit for dissipating a high intensity current corresponding to the traction current or to the overhead line-rail short circuit of high power locomotives.

In a first embodiment, each impedance is formed of a capacitor connected in parallel across an inductance having a middle point connected to ground. In this case, the inductance and the capacitor will be preferably both connected to the rails, at points separate from each other on each of these rails, so that an accidental breakage of the connection with the rails of one of the components of the impedance may be immediately detected.

In a second embodiment, each impedance of the track circuit of the invention may advantageously consist of at least two identical dipoles each formed of an inductance in parallel across a capacitor and connected to each other in series, the junction point of these dipoles being grounded. The effect of this arrangement is to eliminate the coupling between the two half windings of the single inductance of the first embodiment.

Finally, for reasons of simplifying construction on the practical level, the inductances forming part of the design of the track circuit impedances of the invention, will be preferably air-cored inductances formed from a few turns of large section cable disposed on a rigid masonry or concrete base.

The present invention will now be described in greater detail, but solely by way of non limitative examples, with reference to the accompanying drawings in which.

Figure 1:
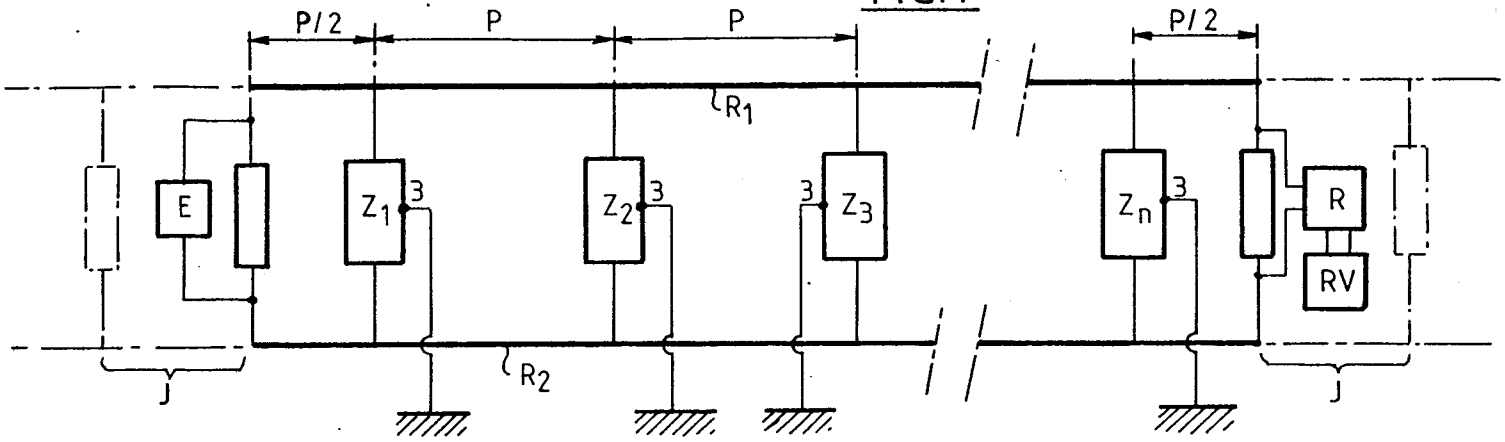
FIG. 1 shows a diagram of a track circuit according to the invention.

The track circuit shown in FIG. 1 is formed by the two rails R1 and R2 of a section of track and comprises in a way known per se, a transmitter E connected to one end of the circuit for generating therein an alternating signal of given frequency, and a receiver R connected to the other end for controlling the operation of a track relay RV. In a way also known per se, this circuit is connected to the neighboring track circuits, shown as (chain-dotted), by means of electrical joints J which may be possibly replaced by conventional insulating joints associated with an inductive connection with middle point connected to ground.

In accordance with the invention, this track circuit is completed by a number of capacitive impedances $Z_1$, $Z_2, \ldots Z_n$ which are connected between the rails $R_1$ and $R_2$. These impedances, which all have substantially the same value, are spaced over the whole length of the track circuit with a substantially constant pitch P therebetween, whereas the distance which separates two end impedances $Z_1$ and $Z_n$ respectively from the output of the transmitter E and from the input of receiver R is substantially equal to P/2.

Figure 2:
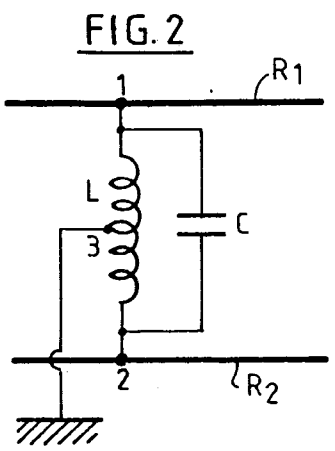
FIGS. 2 to 4 show different embodiments of the impedances equipping this circuit.

In the simplest embodiment shown in FIG. 2, the impedances $Z_1$ to $Z_n$ are each formed by an inductance L connected by its two ends 1 and 2 to rails $R_1$,$R_2$ and having a middle point 3 connected to ground or to a ground cable joining together all the middle points of the inductances L, a capacitor C being connected to the ends 1 and 2 of the inductance L inside the rails $R_1$ and $R_2$.

The number of capacitive impedances $Z_1$ to $Z_n$ and the value of the inductance L and of the capacitor C of each of them are of course determined, in accordance with the desired operating conditions for the circuit, as a function of the other parameters thereof, such as its length, its operating frequency and the insulation of the track.

More precisely, the operating frequency of the circuit should first of all be greater than $$\frac{1}{2\pi\sqrt{lc}}$$

l being the value of the inductance L expressed in Henrys and c the capacitance of the capacitor C in Farads, l and c being then determined as a function of the pitch chosen for spacing the impedances $Z_1$ to $Z_n$ apart along the circuit.

With this condition fulfilled, the attenuation of the transmission provided by the circuit is reduced to a value such that the voltage at the terminals of receiver R, under the most unfavorable conditions, is always higher than that received by this latter should a rail be broken, that is to say when the receiver is supplied by a circuit formed by a single rail and the ground or a single rail and the ground cable. Thus, the track circuit of the invention is endowed with a function for detecting broken rails.

By way of example, a track circuit may be constructed in accordance with the invention having a length of 600 m, operating at the frequency 1700 Hz and comprising two impedances of the same value, $Z_1$ and $Z_2$, each situated at 150 m from each end of the track circuit, each of these impedances comprising an inductance of 50 to 200 $\mu$H in parallel across a capacitor whose capacitance is chosen so that a broken rail may be detected for all the insulation values which the track may have between 1.5 ohm/km and infinity.

Figure 3:
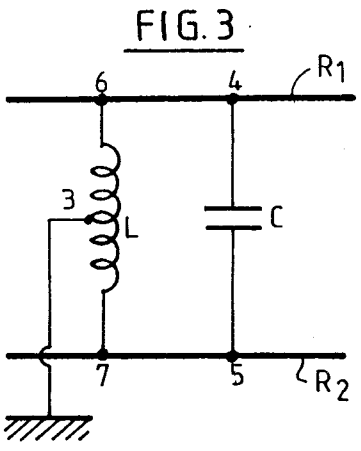

FIG. 3 shows a variant of the impedance shown in FIG. 2, in which the capacitor C is connected not directly to the terminals of inductance L, but to rails $R_1$ and $R_2$ at points 4 and 5 respectively distant by a few tens of centimeters from the corresponding connection points 6 and 7 of the inductance. Thus, an accidental breakage of the connection with one of the rails of the inductance L or of the capacitor C alone may be detected because of the short circuit formed between the two rails by the other component.

Figure 4:
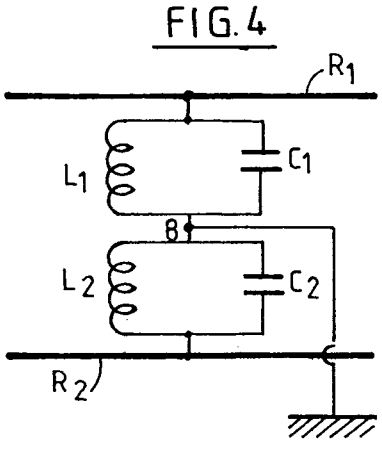

It may further be advantageous to eliminate the coupling between the two half windings of the inductance of FIGS. 2 and 3. This condition is obtained with the embodiment shown in FIG. 4, in which each impedance is formed by at least two identical dipoles each formed by an inductor $L_1$ and $L_2$ respectively connected in parallel across capacitors $C_1$ and $C_2$ and connected to each other in series, the junction point 8 of these dipoles being grounded.

It may be finally added that, for reasons of ease of practical construction, each of the inductances L, $L_1$ or $L_2$ mentioned above will be preferably in the form of an air-cored inductance, formed from a few turns of heavy section cable (70 to 200 mm$^2$) disposed on a rigid masonry or concrete base.

I claim:

1. A track circuit for an AC electrified railway, said track circuit comprising two rails ($R_1$, $R_2$) of a railway track section, a transmitter (E) connected to one end of the circuit for generating therein an alternating current of an operating frequency, f, and a receiver (R) connected to the other end of said circuit for controlling the operation of a track relay (RV), said track circuit further comprising a plurality of impedances ($Z_1$, $Z_2$, . . . $Z_n$), each of said impedances including inductance means and capacitance means connected in parallel with said inductance means, at least said inductance means of each said impedance having a middle point tapped to ground, each of said impedances being connected between said rails ($R_1$, $R_2$) and spaced along the whole length of the rails with a given pitch (P), the values of the impedances being selected so that the transmission attenuation of the circuit at the operating frequency is always less than the transmission attenuation of a circuit of the same length having a broken rail, wherein the value L of the inductance means of each impedance and the capacitance value C of the corresponding capacitance means of each such impedance satisfies the following relation:

$$\frac{1}{2\pi\sqrt{LC}} < f.$$

2. The track circuit according to claim 1, wherein the impedances ($Z_1$ to $Z_n$) have substantially identical values and are spaced along the circuit with a constant pitch (P) therebetween, the two end impedances ($Z_1$,$Z_n$) being spaced respectively from the transmitter (E) and from the receiver (R) by a distance substantially equal to half this pitch (P).

3. The track circuit according to claim 1 or 2, wherein each impedance ($Z_1$ to $Z_n$) is formed by a capacitor (C) connected in parallel across an inductor (L) having a middle point (3) tapped to grounded.

4. The track circuit according to claim 3, wherein the inductor (L) and the capacitor (C) are connected in parallel with one another and to the two rails ($R_1$,$R_2$) at spaced-apart points (4, 5 or 6, 7).

5. The track circuit as claimed in claim 1 or 2, wherein each impedance is formed by at least two identical dipoles, each dipole being formed by an inductor connected in parallel with a capacitor ($C_1$ or $C_2$), said dipoles being connected to each other in series, the junction point (8) of these dipoles being coupled to grounded.

6. The track circuit according to claim 1, wherein the inductors (L, $L_1$, $L_2$) are air inductors formed from a few turns of heavy section cable, disposed on a rigid masonry or concrete base.

* * * * *

UNITED STATES PATENT AND TRADEMARK OFFICE

CERTIFICATE OF CORRECTION

PATENT NO. : 4622522

DATED : November 11, 1986

INVENTOR(S) : Gilbert Alt

It is certified that error appears in the above-identified patent and that said Letters Patent is hereby corrected as shown below:

In claim 1, column 4, line 17, delete "f" and substitute therefor --f--;

Claim 1, column 4, line 32, delete "L" and substitute therefor --L--;

Claim 1, column 4, line 33, delete "C" and substitute therefor --C--; and

Claim 5, column 4, line 57, after "inductor" insert --($L_1$ or $L_2$)--.

Signed and Sealed this

Third Day of February, 1987

*Attest:*

DONALD J. QUIGG

*Attesting Officer*

*Commissioner of Patents and Trademarks*